US009852672B2

(12) United States Patent
Kim et al.

(10) Patent No.: US 9,852,672 B2
(45) Date of Patent: Dec. 26, 2017

(54) METHOD AND APPARATUS FOR CONTROLLING BRIGHTNESS IN A PORTABLE TERMINAL

(75) Inventors: Dong Sub Kim, Suwon-si (KR); Sang Yong Eom, Suwon-si (KR); Joon Gyu Lee, Ansan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 224 days.

(21) Appl. No.: 13/415,105

(22) Filed: Mar. 8, 2012

(65) Prior Publication Data

US 2012/0242633 A1 Sep. 27, 2012

(30) Foreign Application Priority Data

Mar. 21, 2011 (KR) ..... 10-2011-0025019

(51) Int. Cl.
*G09G 5/10* (2006.01)
*G09G 3/20* (2006.01)

(52) U.S. Cl.
CPC ..... *G09G 3/20* (2013.01); *G09G 2320/0285* (2013.01); *G09G 2320/041* (2013.01); *G09G 2320/0626* (2013.01); *G09G 2360/144* (2013.01)

(58) Field of Classification Search
CPC ..... G09G 2320/041; G09G 5/00
See application file for complete search history.

(56) References Cited

U.S. PATENT DOCUMENTS 7,262,753 B2 8/2007 Tanghe et al.
2001/0013854 A1* 8/2001 Ogoro ..... G09G 3/3406 345/102
2003/0132929 A1* 7/2003 Woo ..... G06F 1/203 345/211
2004/0061708 A1* 4/2004 Oh ..... G09G 3/3611 345/690
2004/0130556 A1* 7/2004 Nokiyama ..... G01R 31/3682 345/617
2005/0212824 A1 9/2005 Marcinkiewicz et al.
2006/0202630 A1 9/2006 Yamada
2007/0146303 A1* 6/2007 Kaminosono ..... G09G 3/3406 345/102
2008/0266216 A1 10/2008 Choi
2009/0303209 A1* 12/2009 Teng ..... G09G 3/20 345/204
2010/0045211 A1 2/2010 Kitamura et al.
2010/0091039 A1 4/2010 Marcu et al.
(Continued)

FOREIGN PATENT DOCUMENTS

CN 1497524 A 5/2004
CN 101545600 A 9/2009
(Continued)

*Primary Examiner* — Jennifer Mehmood
*Assistant Examiner* — Carl Adams
(74) *Attorney, Agent, or Firm* — Jefferson IP Law, LLP

(57) ABSTRACT

A method and an apparatus for controlling brightness in a portable terminal are provided. The method comprises measuring temperature according to a preset period, extracting a brightness value mapped to the measured temperature from a stored brightness table, and changing a brightness of the portable terminal to correspond to the extracted brightness value.

23 Claims, 6 Drawing Sheets

(56) References Cited

U.S. PATENT DOCUMENTS

| | | | | |
|---|---|---|---|---|
| 2010/0150378 | A1* | 6/2010 | Lee | H03G 7/002 381/104 |
| 2010/0265228 | A1 | 10/2010 | Kimura et al. | |
| 2012/0188287 | A1* | 7/2012 | Wurzel | G06F 1/203 345/690 |

FOREIGN PATENT DOCUMENTS

| | | | |
|---|---|---|---|
| JP | 2001-060080 | A | 3/2001 |
| JP | 2002-156949 | A | 5/2002 |
| JP | 2006-318733 | A | 11/2006 |
| JP | 2007-535695 | A | 12/2007 |
| JP | 2008-116737 | A | 5/2008 |
| JP | 2008-151946 | A | 7/2008 |
| JP | 2010-8963 | A | 1/2010 |
| JP | 2010-20072 | A | 1/2010 |
| JP | 2010-164602 | A | 7/2010 |
| JP | 2011-47991 | A | 3/2011 |
| KR | 10-2010-0023084 | A | 3/2010 |
| TW | 200952503 | A | 12/2009 |
| WO | 2009/028058 | A1 | 3/2009 |

* cited by examiner

METHOD AND APPARATUS FOR CONTROLLING BRIGHTNESS IN A PORTABLE TERMINAL

PRIORITY

This application claims the benefit under 35 U.S.C. § 119(a) of a Korean patent application filed on Mar. 21, 2011 in the Korean Intellectual Property Office and assigned Serial No. 10-2011-0025019, the entire disclosure of which is hereby incorporated by reference.

BACKGROUND OF THE INVENTION

1. Field of the Invention

The present invention relates to a method and apparatus for controlling brightness in a portable terminal. More particularly, the present invention relates to a method and apparatus for controlling brightness in a portable terminal according to a change of at least one of temperature and illuminance, thereby preventing or reducing a drop of the lifespan of a display unit by controlling the brightness of the display unit.

2. Description of the Related Art

Because of recent rapid technical advances in information and communication technologies, semiconductor technologies, and the like, portable terminals have been widely distributed and used. Such portable terminals generally include a display unit such as a Liquid Crystal Display (LCD), an Organic Light Emitting Display, or the like.

The properties of the display unit tend to change over time. For example, the properties such as brightness, contrast ratio, and the like deteriorate over time. That is, the properties of the display unit such as brightness, contrast ratio, and the like are gradually deteriorated. Consequently, such a display unit cannot be used after a certain amount of time (e.g., after a lifetime of the display unit). The deterioration of the properties of the display unit is affected by temperature and brightness. For example, the lifespan of the display unit is reduced at high temperatures, and the lifespan of the display unit is more quickly reduced as the brightness increases. However, conventional portable terminals are generally maintain the brightness of the display unit at a brightness which is set by users regardless of whether there is a temperature change. In addition, conventional portable terminals generally maintain the brightness of the display unit at a brightness which is automatically set regardless of whether there is a temperature change. As such, the lifespan of the display unit of such portable terminals according to the related art is quickly reduced at high temperatures.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide a method and apparatus for controlling brightness in a portable terminal, which can appropriately control the brightness of the display unit according to a change of at least one of temperature and illuminance.

Another aspect of the present invention is to provide a method and apparatus for controlling the brightness of a portable terminal which can increase the lifespan of a display unit by limiting the brightness of the display unit so as not to exceed the maximum brightness in response to a temperature change with reference to a brightness table in which the maximum brightness, which can be set according to the temperature and illuminance, is mapped and stored.

Another aspect of the present invention is to provide a method and apparatus for controlling brightness in a portable terminal, which informs a user of a limitation of brightness in order to prevent the decrease of the lifespan of the display unit.

In accordance with an aspect of the present invention, a method for controlling brightness in a portable terminal is provided. The method includes measuring temperature according to a preset period, extracting a brightness value mapped to the measured temperature from a stored brightness table, and changing a brightness of the portable terminal to correspond to the extracted brightness.

In accordance with another aspect of the present invention, an apparatus for controlling brightness in a portable terminal is provided. The apparatus includes a display unit, a temperature sensor for measuring temperature, a storage unit for storing a brightness table which stores a mapping of temperature and brightness, and a controller that extracts a brightness value mapped to the measured temperature from the brightness table, and that changes the brightness of the display unit to correspond to the extracted brightness value.

In accordance with another aspect of the present invention, a non-transitory computer-readable storage medium of a portable terminal is provided. The non-transitory computer-readable storage medium stores a program for controlling brightness in a portable terminal. The program includes instructions to cause a computer to measure a temperature according to a preset period, extract a brightness value mapped to the measured temperature from a stored brightness table, and change a brightness of the portable terminal to correspond to the extracted brightness value.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
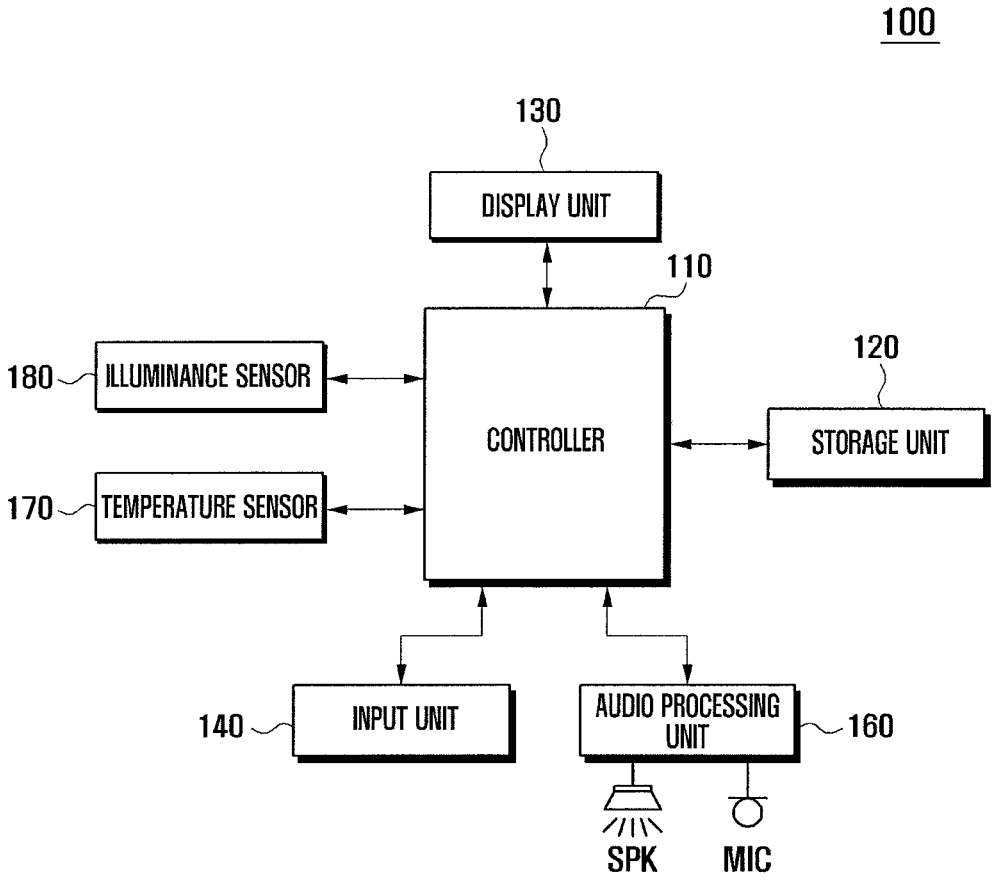
FIG. 1 is a block diagram schematically illustrating a configuration of a portable terminal according to an exemplary embodiment of the present invention.

FIG. 1 is a block diagram schematically illustrating a configuration of a portable terminal according to an exemplary embodiment of the present invention.

Referring to FIG. 1, a portable terminal 100 according to an exemplary embodiment of the present invention includes an illuminance sensor 180, a temperature sensor 170, an audio-processing unit 160, an input unit 140, a display unit 130, a storage unit 120, and a controller 110. As an example, the portable terminal 100 having such a configuration may appropriately adjust brightness of the display unit 130 according to a temperature change. The temperature change may be measured through a temperature sensor 170. According to an exemplary embodiment of the present invention, the portable terminal 100 may decrease the brightness of the display unit 130 if temperature increases. For example, because the lifespan of the display unit 130 quickly decreases as temperature increases, and/or as the brightness gets higher, the portable terminal may monitor the temperature of the display unit 130. In other words, the portable terminal 100 offsets a decrease of the lifespan due to the temperature increase by an increase of the lifespan due to the decrease of the brightness. Accordingly, as the temperature increases, the portable terminal 100 offsets the decreased of the lifespan caused by the temperature increase with a corresponding increase in the lifespan caused by decreasing the brightness of the display unit 130. As such, the portable terminal 100 according to exemplary embodiments of the present invention shows an effect of improving the lifespan of the display unit 130 relative to the portable terminals of the related art. Hereinafter, each component of the portable terminal 100 will be explained in detail.

The audio processing unit 160 may be formed as an acoustic component. The audio processing unit 160 transmits and receives audio signals, and encodes and decodes the audio signals. For example, the audio processing unit 160 may include a CODEC and an audio amplifier. The audio processing unit 160 is connected to a Microphone (MIC) and a Speaker (SPK). The audio processing unit 160 converts analog voice signals inputted from the Microphone (MIC) into digital voice signals, generates corresponding data for the digital voice signals, and transmits the data to the controller 110. Further, the audio processing unit 160 converts digital voice signals inputted from the controller 110 into analog voice signals, and outputs the analog voice signals through the Speaker (SPK). Further, the audio processing unit 160 may output various audio signals generated in the portable terminal 100 through the Speaker (SPK). For example, the audio processing unit 160 can output audio signals according to an audio file (e.g. MP3 file) replay, a moving picture file replay, and the like through the speaker. In particular, the audio processing unit 160 according to exemplary embodiments of the present invention can output an alarm which informs of properties associated with a brightness of the display unit 130. For example, the audio processing unit 160 may output an alarm indicating a limitation of the brightness of the display unit 130.

The illuminance sensor 180 may sense external illuminance (brightness), and transmit a light sensing signal corresponding to the sensed external illuminance to the controller 110. The illuminance sensor 180 may be an optical sensor including a light sensor device such as a transistor, a photo diode, or the like. A detailed explanation of the method of automatically controlling brightness of the display unit 130 through the illuminance sensor 180 will be omitted because the method may be apparent to those skilled in the art.

The temperature sensor 170 measures temperature using devices having different resistance values according to, or as a function of, temperature. As an example, a metal wire, a semiconductor, or the like may have different resistance values according to temperature. That is, the temperature sensor 170 may be any sensor which can measure temperature. For example, the temperature 170 may be a thermister. The thermister is a kind of a temperature sensor, and has properties whose resistance value is changed according to temperature. Using such properties, if the thermister and resistance are serially connected, and if certain voltage is applied, then the voltage between the thermister and resistance is also changed due to a change of the resistance value of the thermister according to a temperature change. That is, the controller 110 can receive a transmitted signal corresponding to the voltage value between the thermister and resistance, and measure temperature.

The input unit 140 may include input keys and function keys for receiving a user input. For example, the input unit 140 may include input keys and function keys for receiving an input of numbers or various sets of letter information, setting various functions, and controlling functions of the portable terminal 100. For example, the input unit 140 may include a calling key for requesting a voice call, a video call request key for requesting a video call, a termination key for requesting termination of a voice call or a video call, a volume key for adjusting output volume of an audio signal, a direction key, and the like. In particular, the input unit 140 according to exemplary embodiments of the present invention may transmit to the controller 110 signals related with automatic mode setting which automatically adjusts brightness of the display unit 130 using at least one of a temperature sensor 170 and an illuminance sensor 180. Such an input unit 140 may be formed by one or a combination of input means such as a touch pad, a touch screen, a button-type key pad, a joystick, a wheel key, and the like.

The display unit 130 displays information inputted by user or information to be provided to user as well as various menus of the portable terminal 100. For example, the display unit 130 may provide various screens according to a user of the portable terminal 100, such as an idle screen, a message writing screen, a calling screen, and the like. In particular, the display unit 130 according to exemplary embodiments of the present invention can display a brightness setting menu screen. As an example, the display unit 130 can output an alarm message that informs a user of brightness properties of the display unit 130. For example, the display unit 130 may output an alarm message that informs of limitation of brightness of the display unit 130. The display unit 130 may inform the user of the brightness properties (e.g., the limitations of brightness of the display unit 130) in the form of a pop-up window, or in the form of an output of an alarm icon in the indicator area. The detailed explanation thereof will be explained later with reference to FIGS. 4 and 5. The display unit 130 can be formed as a Liquid Crystal Display (LCD), an Organic Light Emitting Diode (OLED), an Active Matrix Organic Light Emitting Diode (AMOLED), and the like. However, exemplary embodiments of the present invention are not limited to these examples. For example, exemplary embodiments of the present invention can be applied to all display devices which are sensitive to temperature. In other words, exemplary embodiments of the present invention may be applied to all display devices having a lifespan that is sensitive to or otherwise varies with the temperature. For example, exemplary embodiments of the present invention may be applied to all display devices whose lifespan decrease speed gets faster in high temperatures. Further, the display unit 130 can perform the function of the input unit 140 if the display unit 130 is formed as a touch screen.

The storage unit 120 can store user data, and the like, as well a program which performs operating functions according to an exemplary embodiment of the present invention. For example, the storage unit 120 may store a program for controlling general operation of a portable terminal 100, an Operating System (OS) which boots the portable terminal 100, and application program for performing other optional functions such as a camera function, a sound replay function, an image or video replay function, a Near Field Communication (NFC) function, and the like. Further, the storage unit 120 may store user data generated according to a user of the portable terminal, such as, for example, a text message, a game file, a music file, a movie file, and the like. In particular, the storage unit 120 according to exemplary embodiments of the present invention may store a brightness table which stores a mapping of illuminance, temperature, and brightness. An example of such a brightness table is shown in the Table 1 below.

TABLE 1

| Brightness table | | | | | | |
|---|---|---|---|---|---|---|
| | Manual | Automatic mode (cd/m$^2$) | | | | |
| Temperature (° C.) | mode (cd/m$^2$) | Outdoor 2 | Outdoor 1 | Indoor 2 | Indoor 1 | Night |
| Less than 40 (room temperature) | 300 | 300 | 220 | 160 | 110 | 40 |
| 40 or more~ less than 45 | 250 | 250 | 220 | 160 | 110 | 40 |

TABLE 1-continued

| Brightness table | | | | | | |
|---|---|---|---|---|---|---|
| | Manual | Automatic mode (cd/m$^2$) | | | | |
| Temperature (° C.) | mode (cd/m$^2$) | Outdoor 2 | Outdoor 1 | Indoor 2 | Indoor 1 | Night |
| 45 or more~ less than 50 | 160 | 160 | 160 | 160 | 80 | 40 |
| 50 or more~ less than 54 | 100 | 100 | 100 | 100 | 80 | 40 |
| 54 or more | 40 | 40 | 40 | 40 | 40 | 40 |

In the Table 1 above, the manual mode refers to a mode in which the brightness of the display unit 130 is maintained at a brightness which is set by user regardless of external illuminance, and the automatic mode refers to a mode in which the brightness of the display unit 130 is automatically adjusted according to the external illuminance which is recognized through the illuminance sensor 180. Referring to the Table 1 above, the brightness table is divided into the manual mode and the automatic mode. The automatic mode has 5 levels of temperature sections. Further, as shown in Table 1, the brightness of the display unit 130 is mapped according to a temperature section. Further, in the Table 1 above, five levels of temperature sections have been used. However, exemplary embodiments of the present invention are not limited to this example. That is, the temperatures may be variously divided into two or more levels depending on, for example, a designer's or manufacturer's intention. Further, the external illuminance according to the automatic mode is divided into five levels. However, the external illuminance may also be variously divided into two or more levels depending on, for example, the designer's or the manufacturer's intention. Further, the Table 1 above illustrates an example, and the brightness table may be variously modified according to the type of the display unit 130 and according to, for example, the designer's intention or the manufacturer's intention. Controlling the brightness of the display unit 130 using the brightness table will be explained later in detail with reference to the controller 110.

The controller 110 may control general operation of the portable terminal 100. For example, the controller 110 may control operation of the various components or units included in the portable terminal 100. The controller 110 may transmit a signal to the various components included in the portable terminal 100 and control a signal flow between internal blocks of the portable terminal 100. In particular, the controller 110 according to exemplary embodiments of the present invention can control brightness of the display unit 130 according to a change of temperature and illuminance. To this end, the controller 110 may measure temperature through the temperature sensor 170, and extract a corresponding brightness value mapped according to the temperature measured through the brightness table stored in the storage unit 120. Thereafter, the controller 110 may confirm whether the current brightness exceeds the extracted brightness value by comparing the current brightness of the display unit 130 with the extracted brightness value. If the portable terminal 100 is operating in the manual mode, then the current brightness can be brightness which is preset by user, and if the portable terminal 100 is operating in the automatic mode, then the current brightness can be brightness which is automatically set according to the external illuminance recognized through the illuminance sensor 180. Hereinafter, the method of controlling brightness will be explained in more detail by dividing the method into the manual mode and the automatic mode.

First, according to the manual mode, if the brightness, which is preset by user, exceeds the extracted brightness value, the controller 110 can change the brightness of the display unit 130 to correspond to the extracted brightness value. That is, the controller 110 can limit brightness of the display unit 130 in order to prevent the decrease of the lifespan of the display unit 130 which occurs at high temperatures. Further, if the preset brightness does not exceed the extracted brightness value, then the controller 110 may maintain the brightness of the display unit 130 at the preset brightness by user. For example, if the brightness of the display unit 130 has been manually set to be 270 cd/m$^2$, and if the brightness table such as, for example, the above Table 1 is stored, then if the measured temperature is less than 40° C., because the preset brightness 270 cd/m$^2$ is smaller than the extracted brightness 300 cd/m$^2$, the controller 110 may maintain the brightness of the display unit 130 at preset brightness 270 cd/m$^2$. In contrast, if the temperature is between 40° C. and 45° C., because the preset brightness 270 cd/m$^2$ exceeds the extracted brightness 250 cd/m$^2$, the controller 110 changes the brightness of the display unit 130 to the extracted brightness 250 cd/m$^2$. Similarly, if the temperature is between 45° C. and 50° C., because the preset brightness 270 cd/m$^2$ exceeds the extracted brightness 160 cd/m$^2$, the controller 110 changes the brightness of the display unit 130 to the extracted brightness 160 cd/m$^2$. Here, the brightness of the display unit 130 can be performed by controlling voltage or current supplied to the emitting device of the display unit 130, or by adjusting an on/off time of the emitting device. Such a method of controlling brightness may be apparent to those skilled in the art, and thus the detailed description thereof is omitted here.

Further, while operating the portable terminal 100 based on the manual mode, if the mode is changed to the automatic mode according to user's request, then the controller 110 can control to apply the brightness value according to the current state to the display unit 130 regardless of the brightness value which is set in the manual mode. For example, if the automatic mode setting corresponds to "Outdoor 1" and if the current temperature is less than 40° C., then even though the brightness value for the manual mode is set to 300 cd/m$^2$, if the brightness adjustment mode is changed from the manual mode to the automatic mode, then the brightness value of the display unit 130 can be controlled to be automatically adjusted to 220 cd/m$^2$ which corresponds to the brightness value associated with the automatic mode setting "Outdoor 1" for the current temperature of less than 40° C. If the brightness value of the display unit 130 for the manual mode was set as 300 cd/m$^2$, and if the mode is changed to the automatic mode, then such a function can be a function for setting the brightness of the portable terminal 100 so that the brightness value becomes a highly visible value while also securing the lifespan of the display unit 130. Further, if an input signal for a request to change the mode from the automatic mode to the manual mode is generated, then the controller 110 can be controlled to change the mode to the preset manual mode.

Further, if the portable terminal is operating under the automatic mode, then the controller 110 may control the brightness of the display unit 130 in response to at least one of a temperature change and an external illuminance change. That is, if the external illuminance is constant, and if the temperature is changed, then the controller 110 may control to change the brightness by comparing the current brightness with a brightness value stored in the brightness table such as, for example, according to the brightness table corresponding to the illuminance in the Table 1. For example, if the current brightness value (e.g., illuminance value) is measured to be the brightness value (e.g., illuminance value) corresponding to the automatic mode setting "Outdoor 2", and if the temperature is changed, then the controller 110 can compare the brightness value corresponding to the new temperature with the current brightness based on the brightness table corresponding to the automatic mode setting "Outdoor 2", and control the brightness adjustment according to the result of the comparison. That is, the controller 110 may control the brightness change so that the current brightness of the display unit 130 can be less than 300 cd/m$^2$, 250 cd/m$^2$, 160 cd/m$^2$, 100 cd/m$^2$ and 40 cd/m$^2$, respectively according to a temperature change in the external illuminance environment corresponding to the automatic mode setting "Outdoor 2".

Further, if the temperature is constant, and if the external luminance is changed, then the controller 110 may control to automatically change the brightness of the portable terminal 100 with reference to the stored brightness table such as, for example, the brightness table of Table 1, according to an illuminance change. For example, if the current temperature is less than 40° C., then the controller 110 may adjust the current brightness of the display unit 130 to be less than 300 cd/m$^2$, 220 cd/m$^2$, 160 cd/m$^2$, 110 cd/m$^2$ and 40 cd/m$^2$, respectively, according to a illuminance change corresponding to the automatic mode settings "Outdoor 2", "Outdoor 1", "Indoor 2", "Indoor 1" and "Night", etc. Likewise, the controller 110 according to exemplary embodiments of the present invention may control a brightness (e.g., an illuminance) change to be performed based on a temperature and an illuminance change.

Further, in the above explanation, the values in the brightness table corresponding to the automatic mode settings "Outdoor 2", "Outdoor 1", "Indoor 2", "Indoor 1" and "Night", etc. are values corresponding to a certain brightness (e.g., illuminance value), respectively. The values may be the experimental average in a certain area. Specifically, in the case of the external illuminance, the external illuminance values may vary depending on the area, and there may be a difference in the external illuminance depending on the date and time. Hence, the brightness value (e.g., illuminance value) corresponding to the automatic mode setting "Outdoor 2" and "Outdoor 1" can be measured and determined for each area and time. Here, the values corresponding to the automatic mode setting "Outdoor 2" and "Outdoor 1" are values for distinguishing time slots. For example, the value corresponding to the automatic mode setting "Outdoor 1" may be a brightness value (e.g., an illuminance value) corresponding to a certain time slot such as, for example, a brightness value corresponding to morning, noon, or afternoon. The value corresponding to the automatic mode setting "Outdoor 2" may be a brightness value (e.g., an illuminance value) corresponding to a certain time slot, such as, for example, a brightness value corresponding to morning or afternoon. The values corresponding to the automatic mode settings "Indoor 2" and "Indoor 1" are values corresponding to the brightness value (e.g., illuminance value) measured indoors, which can also vary depending on the area. For example, there can be an area at which a relatively bright interior illumination is used, or an area at which a relatively dark interior illumination is used. Further, the values corresponding to the automatic mode settings "Outdoor 2 and "Outdoor 1" can be brightness values (e.g., illuminance values) for each time slot. That is, the values corresponding to the automatic mode settings "Outdoor 2 and "Outdoor 1" reflect the fact that illuminance can be changed according to external environment, that is, time slots corresponding to noon, the morning or the afternoon. As an example, such a distinction may be made even indoors. As explained above, the brightness values (e.g., the illuminance values), which are given certain titles, may vary depending on the area, time, and culture. Accordingly, it may be preferable to calculate the overall average for a design. Additionally, it may be preferable to measure the brightness values (e.g., the illuminance values) differently for each area and each time slot. The measured brightness values may be applied differently for each area and each time slot.

If the illuminance of the display unit 130 exceeds the brightness which is manually set by user or the brightness which is automatically set according to the external illuminance, that is, if the brightness of the display unit 130 exceeds the preset brightness value and is limited by high temperature, the user of the portable terminal 100 may be notified of such a context or fact. For example, the portable terminal 100 may inform or communicate such a fact to a user through visible, auditory or tactile means. For example, the controller 110 may output an alarm message, which informs a user that the brightness of the display unit 130 has been limited. The alarm message may be output at one end of the display unit 130 in the form of a pop-up window. As another example, the controller 110 may output an alarm icon in the indicator area. Further, the controller 110 may output an alarm sound through an audio processing unit 160, or generate a vibration through a vibration motor (not shown).

The controller 110 can output the brightness setting menu screen in the display unit 130 when executing the brightness setting mode. The user may select which mode under which to operate the portable terminal 100. For example, the user may select whether to operate the portable terminal 100 under the automatic mode or the manual mode through the brightness setting menu. If the user selects the manual mode, then the controller 110 may set the brightness of the display unit 130 at the brightness which is set by user. At this time, the controller 110 may set a limit so that user cannot set the brightness of the display unit 130 to exceed the brightness mapped with the current temperature. Further, if the user requests the brightness change of the display unit 130 to a brightness that exceeds the mapped brightness, then the controller 110 may output a warning message. The detailed explanation thereof will be described later with reference to FIGS. 4 and 5.

Further, although not illustrated in FIG. 1, the portable terminal 100 according to exemplary embodiments of the present invention may further optionally include components for providing additional functions, such as a camera module for taking an image or a moving picture, a broadcast reception module for broadcast reception, a digital music source replay module such as an MP3 module or the like for replay of music or media files, a near field communication module for near field communication, a proximity sensor for proximity sensing, and the like. Such components may be variously modified, and thus not all such modified components are listed here. The portable terminal 100 according to exemplary embodiments of the present invention may further include components of the same level as that of the above mentioned components.

Figure 2:
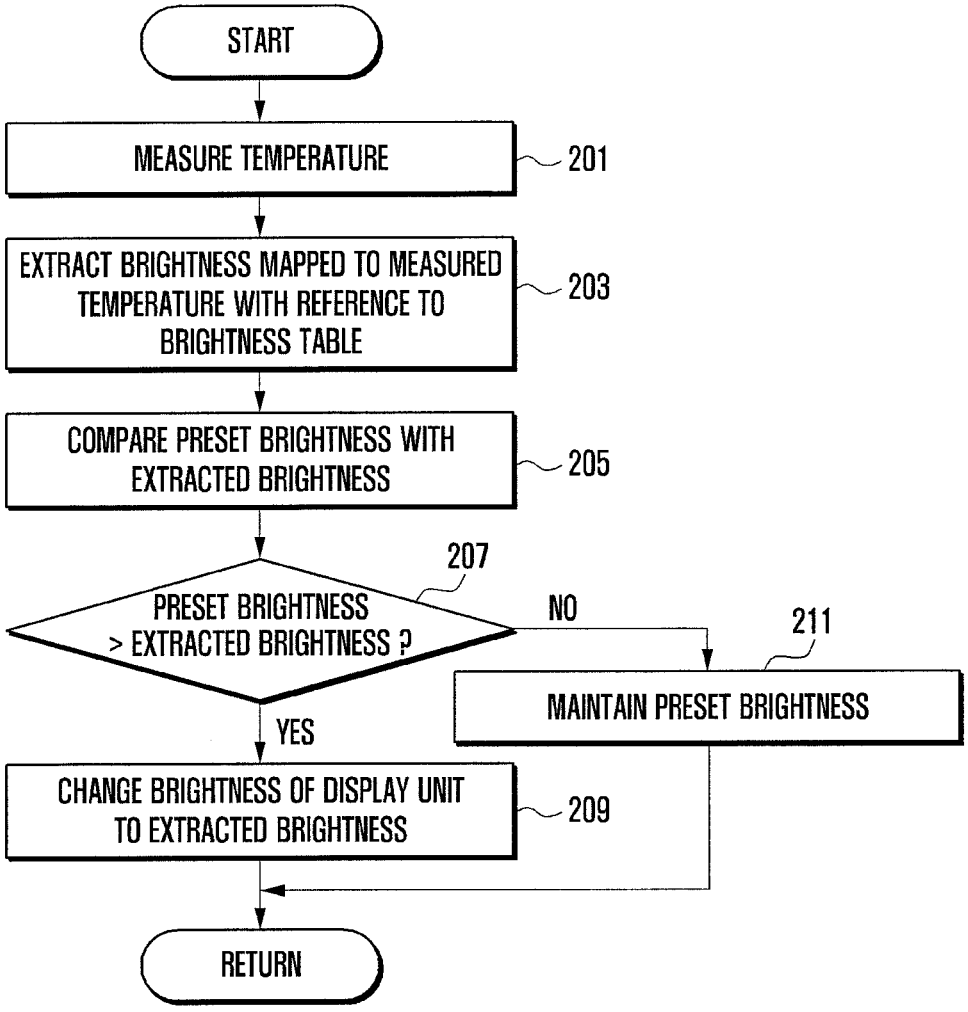
FIG. 2 is a flowchart illustrating a method of controlling brightness of a portable terminal at a manual mode according to an exemplary embodiment of the present invention.

FIG. 2 is a flowchart illustrating a method of controlling brightness of a portable terminal at a manual mode according to an exemplary embodiment of the present invention. With regard to the description of FIG. 2, it is assumed that the brightness of the display unit 130 is preset by user.

Referring to FIG. 2, the controller 110 according to an exemplary embodiment of the present invention may periodically measure the temperature, according to a preset period, through the temperature sensor 170 at step 201. The controller 110 may extract the brightness mapped to the measured temperature from the brightness table stored in the storage unit 120 at step 203. The controller 110 may compare the preset brightness of the display unit 130 with the extracted brightness at step 205, and may determine whether the preset brightness of the display unit 130 exceeds the extracted brightness at step 207. If the preset brightness of the display unit 130 exceeds the extracted brightness, then the controller 110 may change the brightness of the display unit 130 to the extracted brightness at step 209. At this time, though not illustrated, the controller 110 may notify user that the brightness of the display unit 130 has been limited due to the high temperature. For example, the notification may be performed through at least one of a visible means (e.g., an alarm message or an icon output), an auditory means (e.g., an alarm sound output), and a tactile means (e.g., a vibration output). Further, if the brightness of the preset display unit 130 is less than the extracted brightness, then the controller 110 can maintain the brightness of the display unit 130 at the preset brightness at step (211. For example, if it is assumed that the brightness of the display unit 130 is set to 270 cd/m$^2$, and the brightness table corresponds to the brightness table provided in Table 1 above, and if the temperature measured through the temperature sensor 170 is less than 40° C., then the controller 110 may maintain the brightness of the display unit 130 at the preset brightness 270 cd/m$^2$ because the brightness 270 cd/m$^2$ of the preset display unit 130 is smaller than the extracted brightness 300 cd/m$^2$. In contrast, if the temperature is between 40° C. and 45° C., then because the preset brightness 270 cd/m$^2$ of the display unit 130 exceeds the extracted brightness 250 cd/m$^2$, the controller 110 changes the brightness of the display unit 130 to the extracted brightness 250 cd/m$^2$. If the temperature is between 45° C. and 50° C., then because the preset brightness 270 cd/m$^2$ of the display unit 130 exceeds the extracted brightness 160 cd/m$^2$, the controller changes the brightness of the display unit 130 to the extracted brightness 160 cd/m$^2$. The brightness control of the display unit 130 according to such a temperature change can be repeated until the power of the portable terminal 100 is turned off, the display unit 130 is turned off, or the mode under which the portable terminal 100 operates is changed to the automatic mode.

Further, it was explained above that the brightness of the display unit 130 is controlled by comparing the preset brightness of the display unit 130 with the extracted brightness. However, exemplary embodiments of the present invention are not limited to this example. That is, the controller 110 may measure the temperature, and may change the brightness of the display unit 130 to the brightness mapped to the measured temperature, which is prevents or reduces the load on the controller 110 by simplifying the brightness controlling process.

Likewise, exemplary embodiments of the present invention can prevent rapid lifespan deterioration of the display unit which is generated by maintaining the constant brightness at high temperatures by controlling to decrease the brightness of the display unit 130 as the temperature increases.

Figure 3:
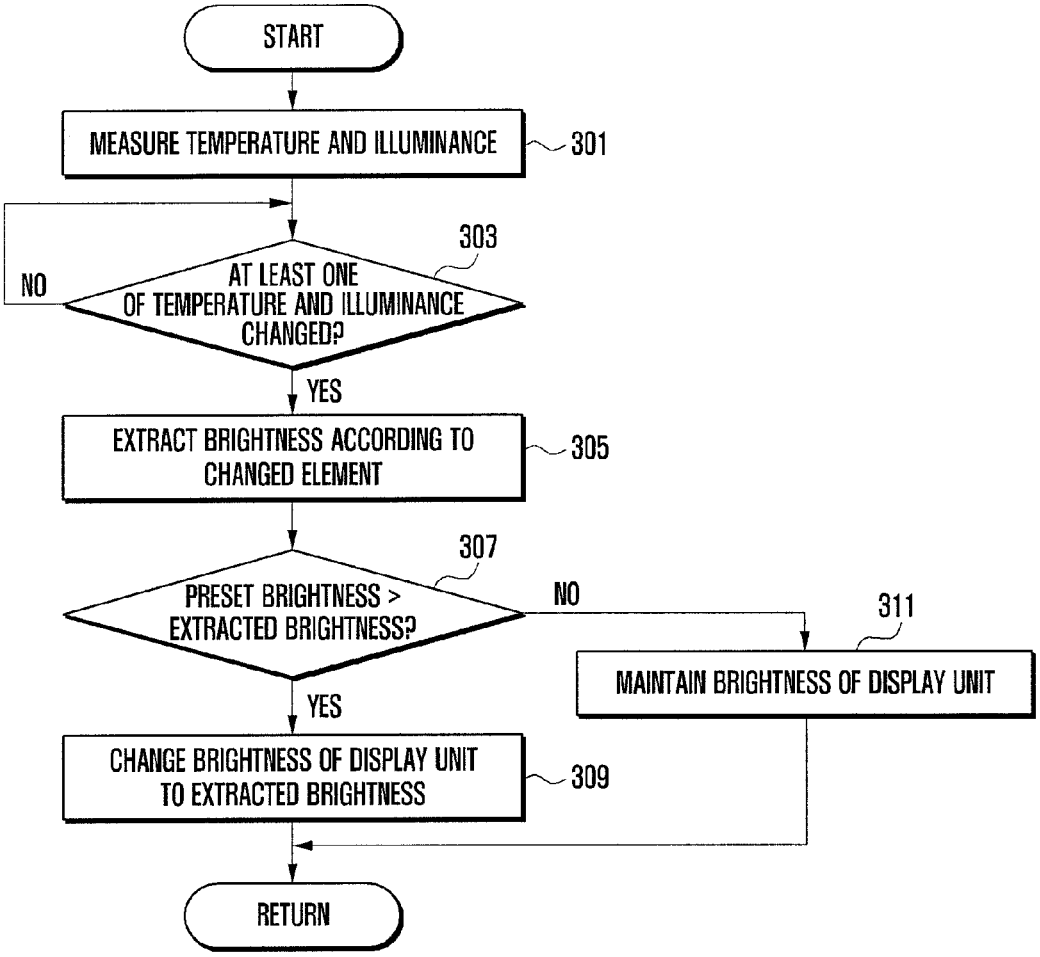
FIG. 3 is a flowchart illustrating a method of controlling brightness of a portable terminal at an automatic mode according to an exemplary embodiment of the present invention.

FIG. 3 is a flowchart illustrating a method of controlling brightness of a portable terminal at an automatic mode according to an exemplary embodiment of the present invention.

Referring to FIG. 3, the controller 110 according to an exemplary embodiment of the present invention can periodically measure the temperature and illuminance according to a preset period using a temperature sensor 170 and a illuminance sensor 180 at step 301. The controller 110 can determine whether at least one of the temperature and illuminance is changed at step 303. If neither the temperature nor the illuminance is changed, then the controller 110 can remain at step 303. In contrast, if at least one of the temperature and the illuminance is changed, then the controller 110 can extract the brightness value according to changed elements with reference to the brightness table at step 305. For example, if the illuminance value is changed from a value corresponding to the automatic mode setting "Outdoor 2" to a corresponding to the automatic mode setting "Outdoor 2" and the temperature is less than 10° C., then the controller adjusts the extracted brightness value from 300 cd/m$^2$ to 220 cd/m$^2$.

Next, the controller 110 compares the adjusted extracted brightness value and the preset brightness value of the display unit 130 at step 307. As a result of the comparison, if the brightness value of the display unit 130 is smaller than the adjusted extracted brightness value, then the controller 110 can control to maintain the brightness value of the display unit 130 which is currently set at step 311. For example, if the brightness value of the preset display unit 130 is 160, then the controller 110 can control to maintain the preset brightness value of the display unit 130.

Further, if the currently set brightness value of the display unit 130 is larger than the adjusted extracted brightness value, then the controller can control to adjust the brightness value of the display unit 130 to the extracted value at step 309. For example, if the brightness value of the preset display unit 130 is 250 cd/m$^2$, then the controller 110 can control to adjust the preset brightness value of the display unit 130 to 220 cd/m$^2$.

At this time, the controller 110 can notify the user that the brightness of the display unit 130 has been limited due to high temperatures or according to a high illuminance change. For example, the controller 110 may notify the user through a visible, auditory, or tactile means that the brightness of the display unit 130 has been limited due to high temperatures or according to a high illuminance change. For example, the controller 110 can output an alarm message, which informs that the brightness of the display unit 130 has been limited, in the form of a pop-up window, or output an alarm icon in the indicator area. The indicator area may be an area which outputs battery life or status, received signal strength, and the like, in the form of icons.

The brightness control of the display unit 130 according to such a temperature and illuminance change can be repeated until the power of the portable terminal 100 is turned off, or the display unit 130 is turned off.

As explained above, exemplary embodiments of the present invention exhibit an effect of improving the lifespan of the display unit 130 by appropriately controlling the brightness of the display unit 130 according to a change of at least one of temperature and illuminance in the automatic mode state.

Figure 4:
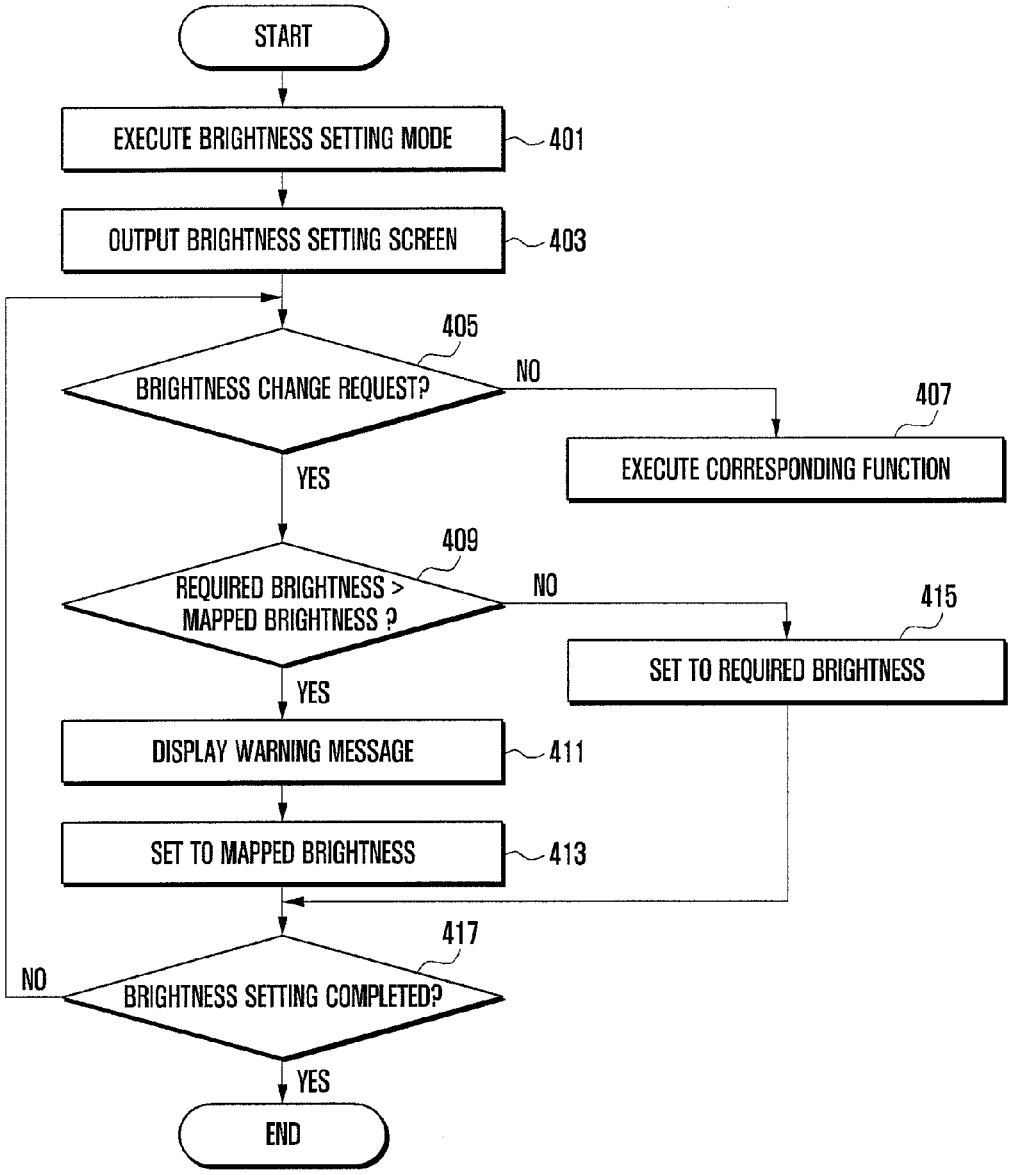
FIG. 4 is a flowchart illustrating a method of setting brightness of a portable terminal according to an exemplary embodiment of the present invention.
Figure 5:
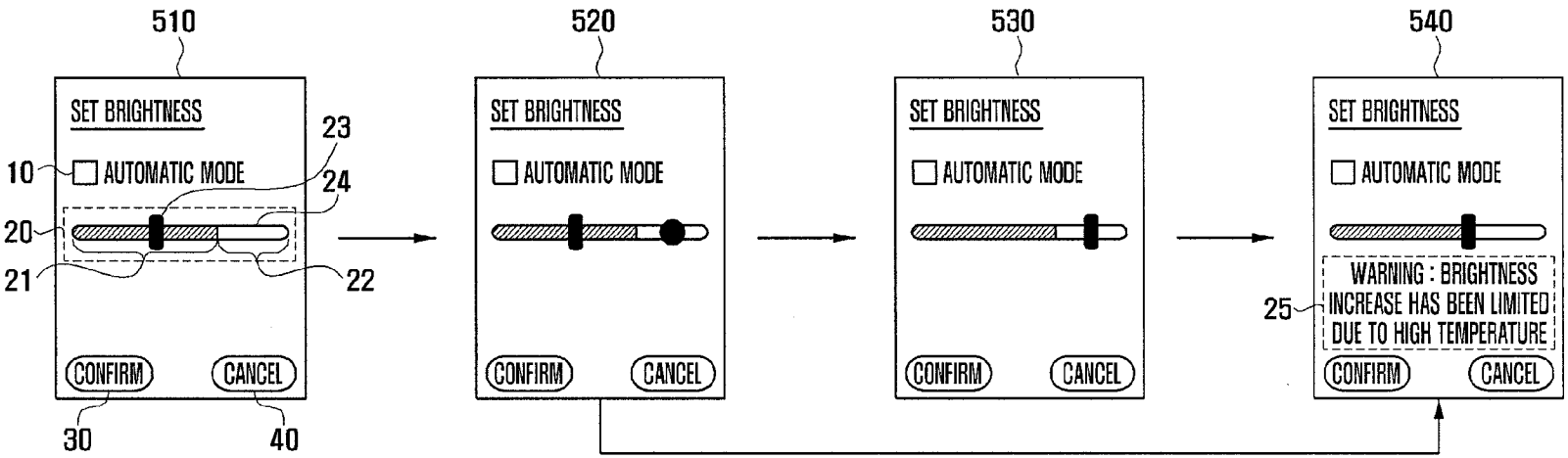
FIG. 5 is a series of screen shots illustrating a method of setting brightness of a portable terminal according to an exemplary embodiment of the present invention.

FIG. 4 is a flowchart illustrating a method of setting brightness of a portable terminal according to an exemplary embodiment of the present invention. FIG. 5 is a series of screen shots illustrating a method of setting brightness of a portable terminal according to an exemplary embodiment of the present invention.

Referring to FIGS. 4 and 5, the controller 110 according to an exemplary embodiment of the present invention can sense the execution of the brightness setting mode at step 401. If the brightness setting mode is executed, the controller 110 can control the display unit 130 to output the brightness setting menu screen at step 403. For example, the controller 110 may control the display unit 130 to output a brightness setting menu screen such as, for example, a screen shot indicated by reference numeral 510 of FIG. 5. The brightness setting menu can include an automatic mode menu 10 which can set the automatic mode, a brightness adjustment menu 20 which can manually adjust the brightness, a confirmation key 30 which performs a brightness setting completion function, and a cancelation key 40 which performs a cancellation function. The user can set the automatic mode by touching or otherwise selecting the box of the automatic mode menu 10. When touching or selecting the box of the automatic mode menu, the controller 110 can output a check mark or other indicia in the box to notify that automatic mode has been set. If the automatic mode is set, then the brightness adjustment menu 20 can be displayed as the inactivated state such that the user cannot provide input to adjust the brightness. For example, the brightness adjustment menu 20 may be displayed as the inactivated state such that the user cannot perform a touch input. If the check mark or other indicia is displayed in the box of the automatic mode menu 10, and if the automatic mode menu 10 is touched, then the controller 110 can remove the check mark or other indicia, and thereby cancel the selection of the automatic mode.

The brightness adjustment menu 20 may include a state bar 24 indicating the overall brightness and a process bar 23 indicating the current brightness. The state bar 24 can be divided into a first brightness area 21 indicating selectable brightness and a second brightness area 22 indicating non-selectable brightness. The sizes of the first brightness area 21 and the second brightness area 22 vary depending on the temperature. The first brightness area 21 includes brightness levels corresponding to permissible levels of brightness of the display unit 130 and the second brightness area 22 includes brightness levels corresponding to impermissible levels of brightness of the display unit 130 at the measured temperature. That is, the boundary between the first brightness area 21 and the second brightness area 22 can be brightness mapped to temperature. For example, if the current temperature is between 45° C. and 50° C., then the boundary between the first brightness area 21 and the second brightness area 22 can be set in the position indicating the brightness of 160 cd/m$^2$. Further, it may be desirable for the display unit 130 to display a screen so that the first brightness area 21 can be visibly distinguished from the second brightness area 22, through which user can easily recognize brightness which can be currently set. In order to distinguish the first brightness area 21 from the second brightness area 22, the controller 110 can measure temperature and extract the brightness mapped to the measure temperature from the brightness table when executing the manual mode.

If the brightness setting screen is being output by the display unit 130, then the controller 110 can determine whether a brightness change is requested at step 405. If the brightness change is not requested, then the controller 110 can perform a corresponding function at step 407. For example, when a touch occurs in the automatic mode menu 10, the controller 110 can output a check mark or other indicia in a box, and change the brightness adjustment menu 20 to an inactivated state. Further, in response to the cancellation key 40 input (e.g., a touch), the controller 110 can return to the previous step. In contrast, if the brightness change is required, then the controller 110 can determine whether the change-requested brightness exceeds the brightness corresponding to the boundary between the first area 21 and the second area 22, that is, the brightness mapped to the current temperature at step 409. If the change-requested brightness exceeds the mapped brightness, then the controller 110 can output a warning message that informs the user that it is not possible to set to the change-requested brightness at step 411, and the process bar 23 can be moved to a position corresponding to the mapped brightness at step 413. For example, as shown in a screen shot corresponding to reference numeral 520 of FIG. 5, if user touches the second area 22 for a brightness change, the controller 110 can output the process bar 23 after moving the process bar 23 to the touched position as shown in the screen shot corresponding to reference numeral 530, output a warning message 25 that informs the user that it is not possible to change to the requested brightness as shown in the screen shot corresponding to reference numeral 540, and output the process bar 23 after moving the process bard 23 to the boundary between the first area 21 and the second area 22. Further, the process associated with the screen shot corresponding to reference numeral 530 may be omitted. That is, when a touch occurs in the second area 22, the controller 110 can move the process bar 23 to the boundary between the first area 21 and the second area 22, and output a warning message.

Further, it was illustrated in FIG. 5 that brightness is changed through a touch. However, exemplary embodiments of the present invention are not limited to this example. For example, the user can change brightness by a drag while touching the process bar 23. As another example, the user may change the brightness by otherwise manipulating the input 140 so as to input corresponding instructions for changing the brightness.

If the change-requested brightness does not exceed the mapped brightness, then the controller 110 can move the process bar 23 to the touch position and change brightness of the display unit 130 to a brightness corresponding to the touched position at step 415, and can move to step 417. The controller 110 may determine whether the brightness setting has been completed. In other words, the controller 110 may determine whether the confirmation key 30 has been inputted at step 417. In case the brightness setting has not been completed, the controller 110 can return to step 405. In case the brightness setting has been completed, the controller 110 can terminate the brightness setting mode of the display unit 130.

Figure 6:
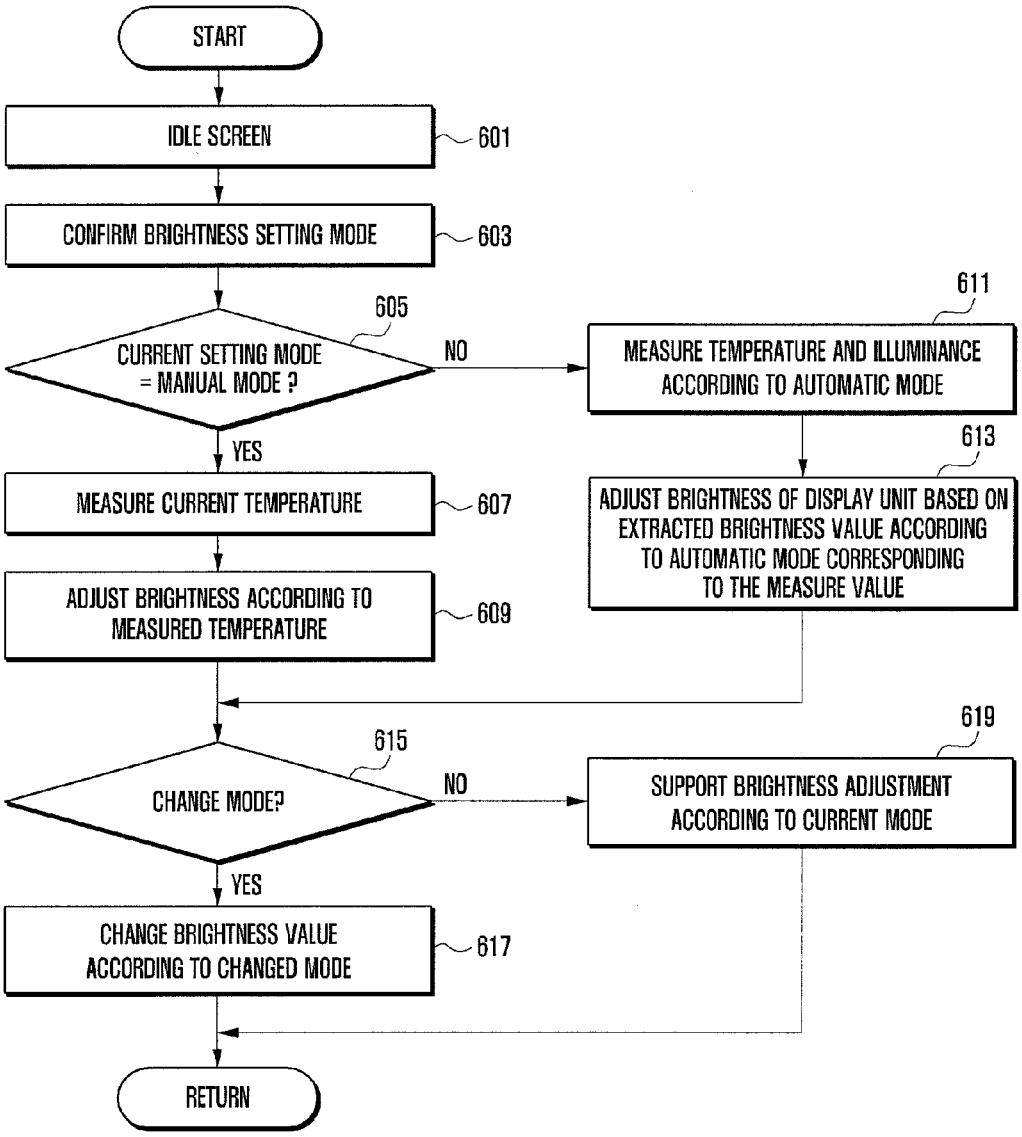
FIG. 6 is a flowchart illustrating a method of operating brightness setting of a portable terminal according to an exemplary embodiment of the present invention.

FIG. 6 is a flowchart illustrating a method of operating brightness setting of a portable terminal according to an exemplary embodiment of the present invention.

Referring to FIG. 6, according to the method of setting brightness of a portable terminal 100 according to exemplary embodiments of the present invention, first, if power is supplied to a portable terminal 100, the controller 110 may control to initialize each configuration of the portable terminal 100. If the initialization process is completed, then the controller 110 may output the idle screen according to preset schedule information at step 601.

Thereafter, the controller 110 checks brightness setting mode at step 603, and determines whether the currently set brightness setting mode is the manual mode at step 605. If the currently set brightness setting mode is the manual mode, then the controller 110 measures the current temperature at step 607. Thereafter, the controller 110 can control to check the extracted brightness value of manual mode as provided in the stored brightness table such as, for example, the brightness table shown in Table 1 according to the measured current temperature, compare the preset brightness value of the display unit 130 with the extracted brightness value of manual mode according to the current temperature, and adjust brightness according to a result of the comparison at step 609. That is, if the preset brightness value of the display unit 130 is larger than the extracted brightness value corresponding to the manual mode according to the temperature, then the controller 110 may control the brightness value of the display unit 130 to be adjusted to the brightness value corresponding to the manual mode, and if the preset brightness value of the display unit 130 is smaller than the extracted brightness value corresponding to the manual mode according to the temperature, then the controller 110 may control to maintain the brightness value of the display unit 130.

Further, as a result of checking the brightness setting mode at step 605, if the mode is set to be the automatic mode, then the controller 110 measures the current temperature and illuminance at step 611. Further, the controller 110 may extract the extracted brightness value corresponding to the automatic mode which corresponds to the measured temperature and illuminance with reference to the already stored brightness table at step 613. Thereafter, the controller 110 may adjust the brightness value of the display unit 130 to correspond to the extracted brightness value corresponding to the automatic mode.

Further, the controller 110 may control to determine whether the mode change has occurred at step 615, and if the mode change has occurred, then the controller 110 may control to adjust the brightness value according to the mode change at step 617. Specifically, if the mode is changed from the manual mode to the automatic mode, the controller 110 may control to change the brightness value of the display unit 130, which is set by user, to the brightness value of the automatic mode, which corresponds to the current temperature and illuminance. Further, if the mode is changed from the automatic mode to the manual mode, then the controller 110 may control to change the brightness value of the display unit 130 to the brightness value which is set by the user at previous manual mode. At this time, the controller 110 may support to set the brightness value of the display unit 130 to the extracted brightness value corresponding to the manual mode which corresponds to the corresponding temperature by measuring the current temperature. If no brightness value has been previously set, then the controller 110 may control to have a certain brightness value set as a default brightness value. If a separate mode change has not occurred at step 615, then the controller 110 may control to support adjusting the brightness according to the currently-set mode at step 619.

Thereafter, the controller 110 may control to return to step 601 and output the idle screen, or to support the user function of the portable terminal 100 corresponding to an input signal inputted from the input unit 140, or the like.

A method for controlling brightness according to exemplary embodiments of the present invention may be implemented in an executable program command form by various computer means and be recorded in a non-transitory computer readable recording medium. The computer readable recording medium may include a program command, a data file, and a data structure individually or a combination thereof. The program command recorded in a recording medium may be specially designed or configured for exemplary embodiments of the present invention, or may be known to a person having ordinary skill in a computer software field.

The computer readable recording medium includes Magnetic Media such as hard disk, floppy disk, or magnetic tape, Optical Media such as Compact Disc Read Only Memory (CD-ROM) or Digital Versatile Disc (DVD), Magneto-Optical Media such as floptical disk, a hardware device such as ROM, RAM, flash memory storing and executing program commands, and the like. Further, the program command includes a machine language code created by a compiler and a high-level language code executable by a computer using an interpreter. The foregoing hardware device may be configured to be operated as at least one software module to perform an operation of exemplary embodiments of the present invention.

As explained above, a method and apparatus for controlling brightness in a portable terminal according to an exemplary embodiment of the present invention can prevent a decrease of the lifespan of a display unit by appropriately controlling the brightness of the display unit according to a change in temperature and illuminance. That is, exemplary embodiments of the present invention can improve the lifespan of the display unit. Further, exemplary embodiments of the present invention can improve user's convenience by displaying the maximum brightness which can be set at the current temperature, limiting the brightness of the display unit so that user cannot set the brightness to a value which exceeds the maximum brightness, and informing user that the brightness of the display unit has been limited.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for controlling brightness in a portable terminal, the method comprising:

measuring temperature according to a preset period;

extracting a brightness value mapped to the measured temperature from a stored brightness table; and changing a brightness of the portable terminal to correspond to the extracted brightness value, wherein the changing of the brightness of the portable terminal comprises:

checking a current brightness value of a display;

comparing the current brightness value with the extracted brightness value that is mapped in the stored brightness table to the measured temperature;

changing a brightness of the display to the extracted brightness value if the current brightness value exceeds the extracted brightness value;

maintaining the brightness of the display at the current brightness value if the current brightness value is less than the extracted brightness value; and displaying a state bar indicating an overall brightness divided into a first brightness area indicating selectable brightness as the brightness of the display and a second brightness area indicating non-selectable brightness as the brightness of the display and a process bar indicating currently set brightness of the display.

2. The method of claim 1, wherein the changing of the brightness of the portable terminal further comprises:

outputting an alarm notification that notifies a user that the brightness of the display has been limited if the current brightness value exceeds the extracted brightness value.

3. The method of claim 1, further comprising:

requesting a brightness change of the portable terminal;

comparing the change-requested brightness with the brightness value mapped to the measured temperature; and changing the brightness of the portable terminal to the mapped brightness if the change-requested brightness exceeds the brightness value mapped to the measured temperature.

4. The method of claim 3, further comprising:

changing the brightness of the portable terminal to the change-requested brightness if the change-requested brightness is less than the brightness value mapped to the measured temperature.

5. The method of claim 3, further comprising:

outputting a warning notification that notifies a user that the brightness of the portable terminal cannot be changed to the change-requested brightness if the change-requested brightness exceeds the brightness value mapped to the measured temperature.

6. The method of claim 3, wherein the requesting of a brightness change of the portable terminal comprises receiving a request for a brightness change in a brightness setting menu that is input by a user.

7. The method of claim 1, further comprising:

measuring an illuminance;

requesting a brightness change automatically according to a change of at least one of the measured luminance and the measured temperature;

extracting a brightness value according to a change of at least one of the illuminance and the temperature from the brightness table; and changing the brightness of the portable terminal to correspond to the extracted brightness value.

8. An apparatus for controlling brightness in a portable terminal, the apparatus comprising:

a display;

a temperature sensor for measuring temperature;

a storage for storing a brightness table which stores a mapping of temperature and brightness; and a processor that extracts a brightness value mapped to the measured temperature from the brightness table, and that changes the brightness of the display to correspond to the extracted brightness value, wherein the processor checks a current brightness value of the display, compares the current brightness value of the display with the extracted brightness value that is mapped in the stored brightness table to the measured temperature, changes a brightness of the display to the extracted brightness value if the current brightness value exceeds the extracted brightness value, and maintains the brightness of the display at the current brightness value if the current brightness value is less than the extracted brightness value, and wherein the processor cause the display to display a state bar indicating an overall brightness divided into a first brightness area indicating selectable brightness as the brightness of the display and a second brightness area indicating non-selectable brightness as the brightness of the display and a process bar indicating currently set brightness of the display.

9. The apparatus of claim 8, wherein the processor outputs an alarm notification, which notifies a user that the brightness of the display has been limited, at one end of the display if the current brightness value exceeds the extracted brightness value.

10. The apparatus of claim 8, further comprising:

an illuminance sensor that senses external illuminance, wherein the processor changes the brightness of the display according to a change of at least one of the external luminance and the measured temperature.

11. The apparatus of claim 8, wherein the processor compares a change-requested brightness with the brightness value mapped to the measured temperature if the processor receives a brightness change of the display request, and changes the brightness of the display to the mapped brightness value and outputs a warning notification that notifies a user that the brightness of the display has been limited if the change-requested brightness exceeds the mapped brightness value.

12. The apparatus of claim 11, wherein the processor changes the brightness of the display to the change-requested brightness if the change-requested brightness is less than the brightness value mapped to the measured temperature.

13. The apparatus of claim 8, wherein the display outputs a brightness setting screen including an automatic mode menu for setting an automatic mode upon execution of a brightness setting mode and a brightness adjustment menu for manually adjusting a brightness of a display upon inactivation of the automatic mode.

14. The apparatus of claim 13, wherein the process bar is moved to a change-requested position, when a brightness change to the second brightness area is requested, and moved to a boundary between the first brightness area and the second brightness area.

15. The apparatus of claim 14, wherein the process bar is moved to a boundary between the first brightness area and the second brightness area when a brightness change to the second brightness area is requested.

16. The apparatus of claim 14, wherein the display outputs an alarm notification that notifies a user that the brightness of the display has been limited after the process bar is moved to a boundary between the first brightness area and the second brightness area.

17. The apparatus of claim 13, wherein the brightness adjustment menu becomes an inactivated state in which a user input is not receivable when the automatic mode is activated.

18. A non-transitory computer-readable storage medium of a portable terminal storing a program for controlling brightness in a portable terminal, the program comprising instructions to cause a computer to:

measure a temperature according to a preset period;

extract a brightness value mapped to the measured temperature from a stored brightness table;

check a current brightness value of a display;

compare the current brightness value with the extracted brightness value that is mapped in the stored brightness table to the measured temperature;

change a brightness of the display to the extracted brightness value if the current brightness value exceeds the extracted brightness value;

maintain the brightness of the display at the current brightness value if the current brightness value is less than the extracted brightness value; and displaying a state bar indicating an overall brightness divided into a first brightness area indicating selectable brightness as the brightness of the display and a second brightness area indicating non-selectable brightness as the brightness of the display and a process bar indicating currently set brightness of the display.

19. The method of claim 1, further comprising:

outputting a brightness setting screen including an automatic mode menu for setting an automatic mode upon execution of a brightness setting mode and a brightness adjustment menu for manually adjusting a brightness of a display upon inactivation of the automatic mode.

20. The method of claim 19, further comprising:

moving the process bar to a change-requested position, when a brightness change to the second brightness area is requested, in a state of the inactivation of the automatic mode; and moving the process bar to a boundary between the first brightness area and the second brightness area.

21. The method of claim 20, further comprising:

moving the process bar to a boundary between the first brightness area and the second brightness area when a brightness change to the second brightness area is requested.

22. The method of claim 20, further comprising:

outputting an alarm notification that notifies a user that the brightness of the display has been limited after the process bar is moved to a boundary between the first brightness area and the second brightness area.

23. The method of claim 19, wherein the brightness adjustment menu becomes an inactivated state in which a user input is not receivable when the automatic mode is activated.

* * * * *